US010388189B2

(12) United States Patent
Rose et al.

(10) Patent No.: US 10,388,189 B2
(45) Date of Patent: Aug. 20, 2019

(54) POP-UP CARD WITH A REMOVABLE NOTECARD

(71) Applicant: LovePop, Inc., Boston, MA (US)

(72) Inventors: Robin S. K. Rose, Cambridge, MA (US); Max N. Freiert, Salem, MA (US); Emilio Latorre Armendariz, Arlington, MA (US); Elana N. Walker, Somerville, MA (US); Dariush S. Nejad, Somerville, MA (US); Mansi Monhani, Jamaica Plain, MA (US)

(73) Assignee: LovePop, Inc., Boston, MA (US)

( * ) Notice: Subject to any disclaimer, the term of this patent is extended or adjusted under 35 U.S.C. 154(b) by 0 days.

(21) Appl. No.: 16/244,553

(22) Filed: Jan. 10, 2019

(65) Prior Publication Data

US 2019/0213921 A1 Jul. 11, 2019

Related U.S. Application Data

(60) Provisional application No. 62/615,771, filed on Jan. 10, 2018.

(51) Int. Cl.

| | |
|---|---|
| ***G09F 1/06*** | (2006.01) |
| ***G09F 1/10*** | (2006.01) |
| *B42D 15/04* | (2006.01) |
| *G09F 1/08* | (2006.01) |

(52) U.S. Cl.

CPC ..... *G09F 1/06* (2013.01); *G09F 1/10* (2013.01); *B42D 15/042* (2013.01); *G09F 1/08* (2013.01)

(58) Field of Classification Search

CPC ..... G09F 1/04; B42D 15/042

USPC ..... 40/124.06, 124.08

See application file for complete search history.

(56) References Cited

U.S. PATENT DOCUMENTS

| | | | | |
|---|---|---|---|---|
| 729,553 | A * | 6/1903 | Demmon | B42D 15/042 40/445 |
| 930,108 | A | 8/1909 | Walcutt | |
| 1,052,187 | A | 2/1913 | Stranders | |
| 1,194,678 | A | 8/1916 | Stranders | |
| 1,541,002 | A | 6/1925 | Shramek | |
| 1,854,225 | A | 4/1932 | Rosenthal | |
| 1,891,011 | A | 12/1932 | Purdy | |
| 1,913,797 | A | 6/1933 | Dulin et al. | |
| 2,103,748 | A | 12/1937 | Horr | |
| 2,511,211 | A | 6/1950 | Klein et al. | |

(Continued)

FOREIGN PATENT DOCUMENTS

| | | |
|---|---|---|
| GB | 2244024 A | 11/1991 |
| GB | 2467115 A | 7/2010 |

(Continued)

OTHER PUBLICATIONS

"Pull-Tab Slider Card," https://www.splitcoaststampers.com/resources/newsletter/apr092014/, Apr. 2014. (Year: 2014).*

(Continued)

*Primary Examiner* — Gary C Hoge

(74) *Attorney, Agent, or Firm* — Foley Hoag LLP; Rajesh Vallabh

(57) ABSTRACT

A pop-up card includes a notecard that can be inserted into and removed from a pocket formed between the cover of the card and a panel secured to and overlaying at least a portion of the cover.

27 Claims, 12 Drawing Sheets

(56) References Cited

U.S. PATENT DOCUMENTS 2,892,278 A 6/1959 Hoeflich
2,974,434 A 3/1961 Gibson
3,228,138 A 1/1966 Lohnes
3,343,297 A 9/1967 Valentine
3,430,761 A 3/1969 Pelkey
4,024,656 A 5/1977 Farnsworth
4,319,418 A 3/1982 Transport
4,349,973 A 9/1982 Penick et al.
D283,231 S 4/1986 Bradenburger
4,826,211 A 5/1989 Sinnott et al.
5,096,751 A 3/1992 Duchek
5,259,133 A * 11/1993 Burtch ..... B42D 15/045 40/124.08
5,261,172 A 11/1993 Rowley
5,317,823 A 6/1994 Brunt, II
5,387,108 A 2/1995 Crowell
5,416,993 A 5/1995 Shields
5,450,680 A 9/1995 Bromberg
D368,276 S 3/1996 Buzby
5,613,612 A 3/1997 Davault
5,658,620 A 8/1997 Ross
5,732,491 A 3/1998 Burtch
5,738,221 A 4/1998 Van Witt et al.
5,746,689 A 5/1998 Murphy
5,761,836 A 6/1998 Dawson
5,884,770 A 3/1999 Galm
5,933,989 A 8/1999 Volkert et al.
5,937,553 A 8/1999 Maran
5,943,800 A 8/1999 Rose
5,947,281 A 9/1999 Kaneff
5,954,194 A 9/1999 Simpson
5,971,157 A 10/1999 Howell et al.
6,059,101 A 5/2000 Gambardella et al.
6,106,023 A 8/2000 Sud et al.
D432,570 S 10/2000 Donaldson
6,267,233 B1 7/2001 Stern et al.
6,279,739 B1 8/2001 Moore et al.
6,311,142 B1 10/2001 Glassner
6,311,418 B1 11/2001 Crowell
6,453,800 B1 9/2002 Chen
6,505,737 B1 1/2003 Sherman
6,640,473 B1 11/2003 Shenk
6,643,962 B1 11/2003 Panec et al.
6,719,189 B1 * 4/2004 Malerba ..... B42D 5/025 229/92.8
6,877,263 B2 4/2005 Clark
6,966,135 B1 11/2005 McDonald
D514,120 S 1/2006 Chan
D545,359 S 6/2007 Bramhall
7,490,425 B2 2/2009 Crowell et al.
D662,543 S 6/2012 Dennis et al.
8,228,327 B2 7/2012 Hendrickson et al.
D742,452 S 11/2015 Paley
D765,777 S 9/2016 Mayer
9,475,333 B2 10/2016 Yeh
9,524,658 B1 12/2016 Wise et al.
9,601,033 B2 3/2017 Wise et al.
D783,717 S 4/2017 Mayer et al.
D802,661 S 11/2017 Salatandre
9,836,997 B1 12/2017 Brandrup
D831,108 S 10/2018 Dennis
2003/0097773 A1 5/2003 Oh
2003/0230515 A1 12/2003 Mouyal
2005/0284927 A1 * 12/2005 Wilen ..... B42D 15/042 235/380
2006/0101678 A1 * 5/2006 Wilen ..... G09F 1/04 40/124.06
2007/0017133 A1 1/2007 Crowell et al.
2007/0293118 A1 12/2007 Prescott
2008/0295374 A1 12/2008 Bergland et al.
2012/0285055 A1 * 11/2012 Glass ..... A47F 7/146 40/124.06
2012/0297650 A1 11/2012 Burley
2013/0139420 A1 6/2013 Rubar
2013/0232828 A1 9/2013 Qiao et al.
2013/0302540 A1 11/2013 Vinecombe
2014/0209496 A1 7/2014 Flynn et al.
2014/0216982 A1 * 8/2014 Boyer ..... B65D 85/00 206/758
2015/0224808 A1 * 8/2015 Shlonsky ..... B42D 15/045 40/124.02
2015/0314950 A1 * 11/2015 Lopez ..... B65D 5/422 206/232
2015/0332611 A1 11/2015 Yeh
2016/0358515 A1 12/2016 Christiansen
2016/0365009 A1 * 12/2016 Wise ..... G09F 1/06
2017/0273253 A1 9/2017 Yeh
2018/0102070 A1 4/2018 Yeh
2018/0102071 A1 4/2018 Yeh

FOREIGN PATENT DOCUMENTS

JP 2000141954 A 5/2000
WO WO-2007149110 A1 12/2007

OTHER PUBLICATIONS

"The Season of Giving," https://www.onehundreddollarsamonth.com/the-season-of-giving-surprising-facts-about-gift-cards/, Dec. 2015. (Year: 2015).*
Hallmark, last accessed on Jan. 9, 2019 <https://www.hallmark.com/cards/greeting-cards/pizza-my-heart-birthday-card-799LAD1525.html>.
Colorpop Cards Cardinal Bird Pop Up Card, Date First Available Nov. 13, 2018, <https://www.amazon.com/Colorpop-Cardinal-greeting-handmade-Animals/dp/B07KFTVQX8/ref=sr_1_cc_2?s=aps&ie=UTF8&qid=1544028298&sr=1-2-catcorr&keywords=color+pop+3d+pop+up+cards>.
Creative Park, http://cp.c-ij.com/en/contents/CNT-0005840/index.html, accessed Jun. 6, 2016.
Creative Popup Cards, http://www.creativepopupcards.com/, accessed Jun. 6, 2016.
Paper Popup Cards, http://paperpopcards.com/, accessed Jun. 6, 2016.
Up With Paper, http://www.upwithpaper.com/, accessed Jun. 6, 2016.
Leah Fedynak, [lfedynak],Jun. 29, 2013 Awe-Inspiring Cards Retrieved from https://birdwingpaperdesigns.com/2013/06/29/awe-inspiring-cards/ (Year: 20 13).
Masahiro Chatani and Keiko Nakazawa,1994, Pop-Up Geometric Origami. Retrieved from https://www.scribd.com/doc/102043532/Pop-Up-Geometric-Origami (Year: 1994).
"Six Amazing Pop-Up Paper Sculptures," You Tube video, posted by Peter Dahmen Papierdesign, Jan. 2, 2010 https://www.youtube.com/watch?v=YuQsxFhBGzw (Year: 2010).

* cited by examiner

POP-UP CARD WITH A REMOVABLE NOTECARD

CROSS REFERENCE TO RELATED APPLICATION

This application claims priority from U.S. Provisional Patent Application No. 62/615,771 filed on Jan. 10, 2018 entitled POP-UP CARD WITH INTEGRATED POCKET FOR HOLDING NOTECARDS AND OTHER ITEMS, which is hereby incorporated by reference.

BACKGROUND

The present application relates generally to pop-up cards and, more particularly, to pop-up cards having an integrated pocket for holding notecards and other items.

Pop-up cards are greeting-type cards that include an erectable pop-up display structure that unfolds from a flattened state when the card is closed to a 3-D state when the card is opened. FIG. 1 shows one example of a prior art pop-up card 100 that includes a rose bouquet pop-up display structure 102 on a foldable card 104.

U.S. Pat. No. 9,524,658, which is incorporated by reference herein in its entirety, illustrates some examples of how such pop-up display structures can be constructed from intersecting slice-form elements and attached to foldable cards. FIG. 2 taken from that patent shows a portion of an exemplary pop-up display structure, which comprises intersecting slice-form elements 106, 108. The slice-form elements 106, 108 include tabs 110, 112, respectively, at their bases. As shown in FIG. 3, the pop-up display structure is attached to the card by inserting and securing the tabs 110, 112 in slots 114 formed in a panel 116 overlaying the card cover.

The pop-up card can also be configured so that the pop-up display structure is secured in, but removable from the rest of the card when desired by a user.

BRIEF SUMMARY OF THE DISCLOSURE

In accordance with one or more embodiments, a pop-up card with a removable notecard is disclosed. The pop-up card includes (a) a cover having an interior face and an opposite exterior face, the cover being foldable along a crease line defining a first section of the cover on one side of the crease line and a second section of the cover on the opposite side of the crease line, the cover being foldable and unfoldable along the crease line between a closed position wherein the first section of the interior face of the cover faces the second section of the interior face of the cover and an opened position wherein the first section of the interior face of the cover and the second section of the interior face of the cover are separated; (b) a panel secured to and overlaying at least a portion of the second section of the cover, wherein the panel and the second section of the cover define a pocket therebetween; and (c) an erectable pop-up display structure comprising a plurality of intersecting slice-form elements on the interior face of the cover such that when the cover is in the closed position, the pop-up display structure is in a flattened state, and wherein when the cover is in the opened position, the pop-up display structure is in an erected 3-D state. The notecard is removably inserted in the pocket between the panel and the second section of the cover.

In accordance with one or more embodiments, a method of using a pop-up card with a removable notecard is disclosed. The method comprises opening the pop-up card by unfolding a cover of the card from a closed position to an opened position thereby automatically causing an erectable pop-up display structure in the pop-up card to move from a flattened state to an erected 3-D state; removing a notecard from a pocket in the pop-up card formed between the cover and a panel secured to and overlaying at least a portion of the cover; and performing a given action on the notecard (such as, e.g., viewing the notecard or writing or drawing on the notecard).

In accordance with one or more embodiments, a pop-up card with a removable notecard is disclosed. The notecard including a tab at one end thereof. The pop-up card comprises (a) a cover having an interior face and an opposite exterior face, the cover being foldable along a crease line defining a first section of the cover on one side of the crease line and a second section of the cover on the opposite side of the crease line, the cover being foldable and unfoldable along the crease line between a closed position wherein the first section of the interior face of the cover faces the second section of the interior face of the cover and an opened position wherein the first section of the interior face of the cover and the second section of the interior face of the cover are separated; (b) a first panel secured to and overlaying at least a portion of the first section of the interior face of the cover; (c) a second panel secured to and overlaying at least a portion of the second section of the interior face of the cover, wherein the second panel and the second section of the cover define a pocket therebetween for receiving and holding the notecard, wherein the tab is visible when the notecard is in the pocket to improve detection of the notecard and to facilitate removal of the notecard from the pocket; and (d) an erectable pop-up display structure comprising a plurality of intersecting slice-form elements on the first and second panels such that when the cover is in the closed position, the pop-up display structure is in a flattened state, and wherein when the cover is in the opened position, the pop-up display structure is in an erected 3-D state.

BRIEF DESCRIPTION OF THE DRAWINGS

Like or identical reference numbers are used to identify common or similar elements.

DETAILED DESCRIPTION

Various embodiments disclosed herein relate to pop-up cards having an integrated pocket for holding notecards. The notecard can contain a personalized message or other information for the recipient of the pop-up card.

Figure 1:
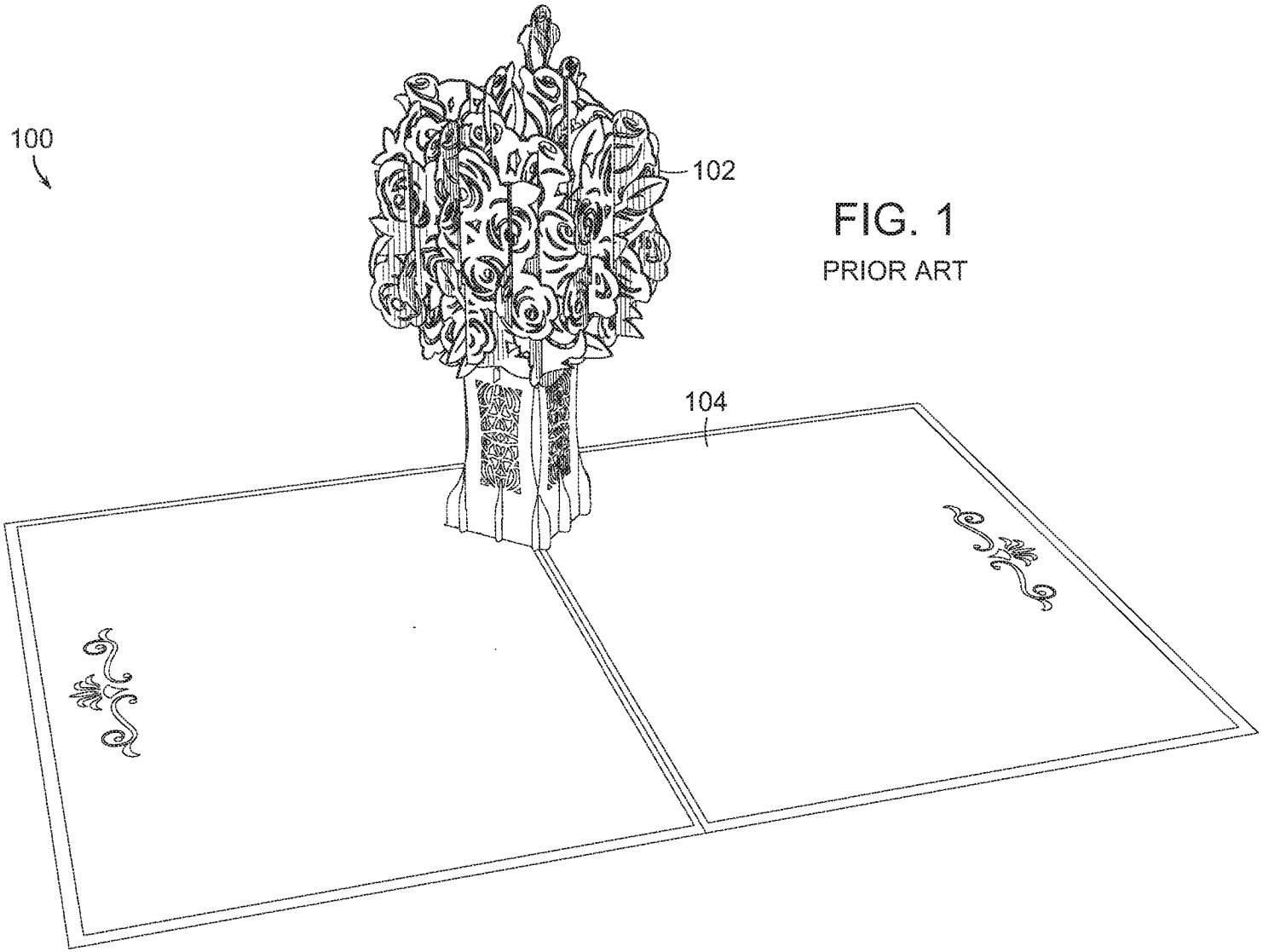
FIG. 1 PRIOR ART
FIG. 1 is a perspective view of a prior art pop-up card.
Figure 2:
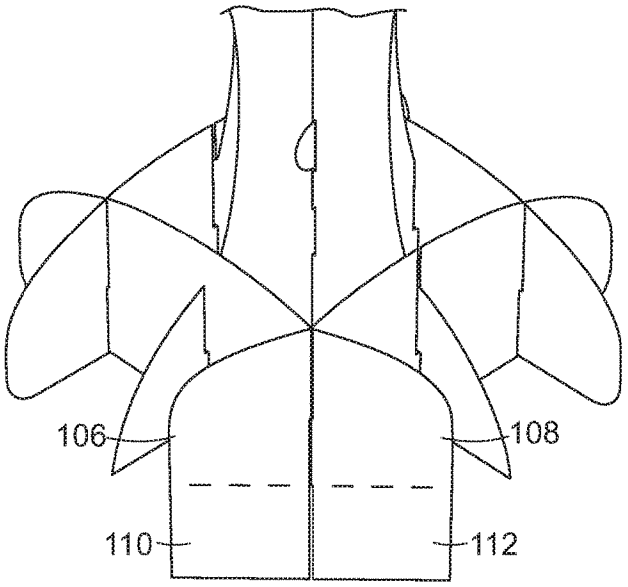
FIG. 2 PRIOR ART
FIGS. 2 and 3 are perspective views of a pop-up display structure attached to card in accordance with the prior art.
Figure 3:
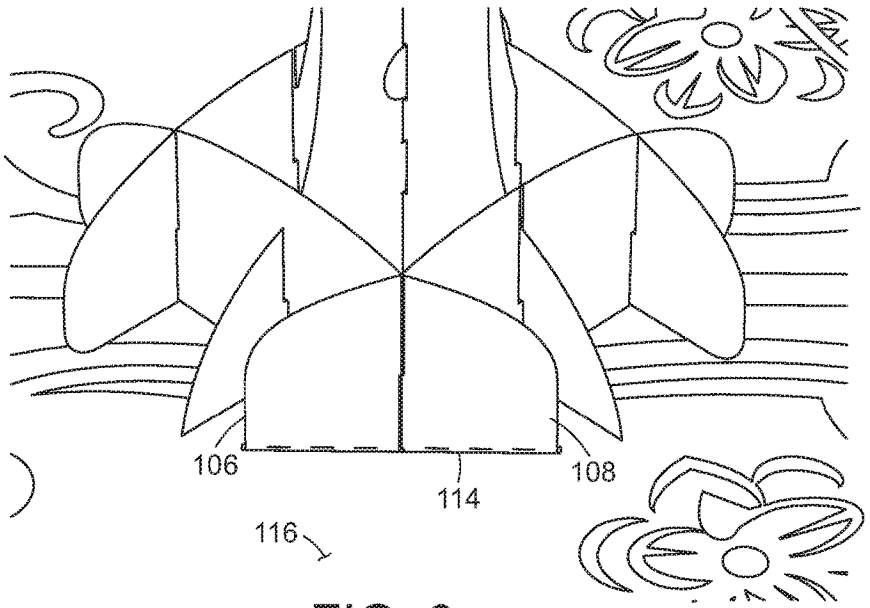
FIG. 3 PRIOR ART
Figure 4:
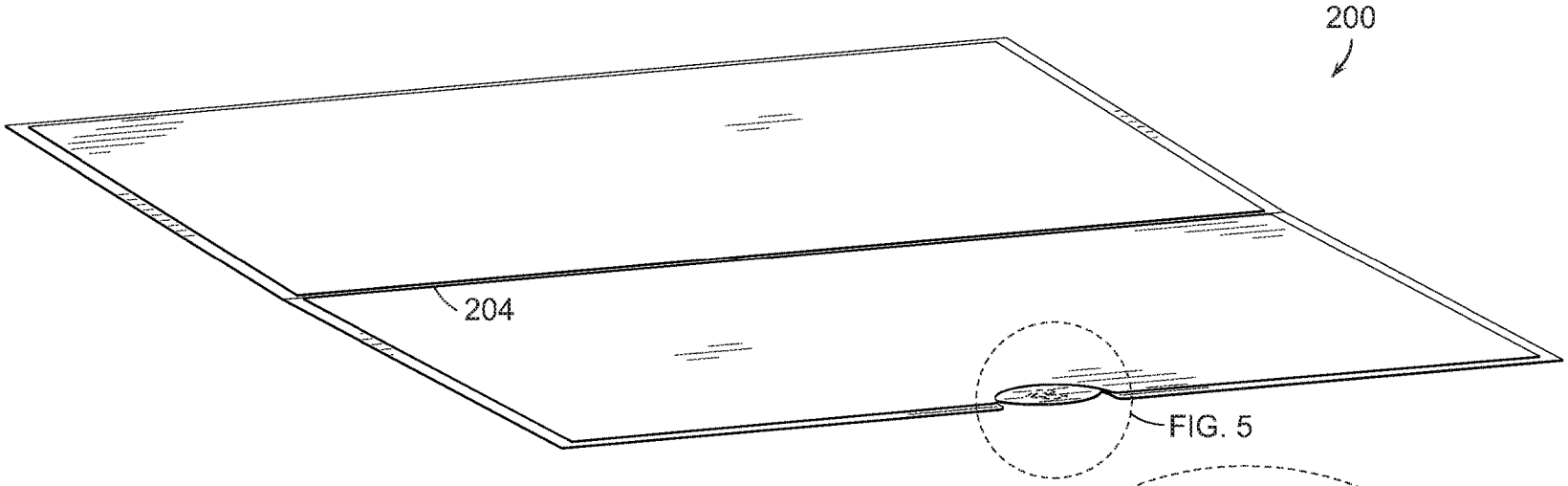
FIG. 4 is a perspective view of a pop-up card in accordance with one or more embodiments.
Figure 5:
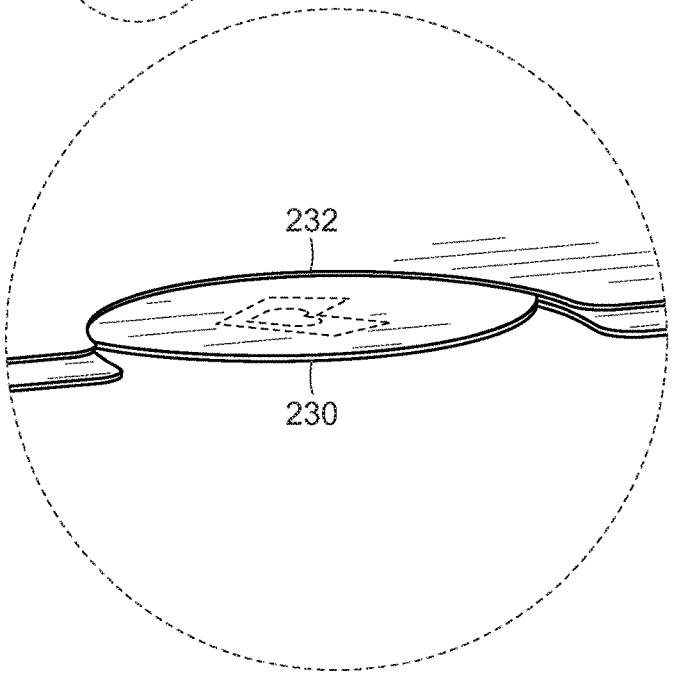
FIG. 5 is an enlarged view of a portion of FIG. 4.
Figure 7:
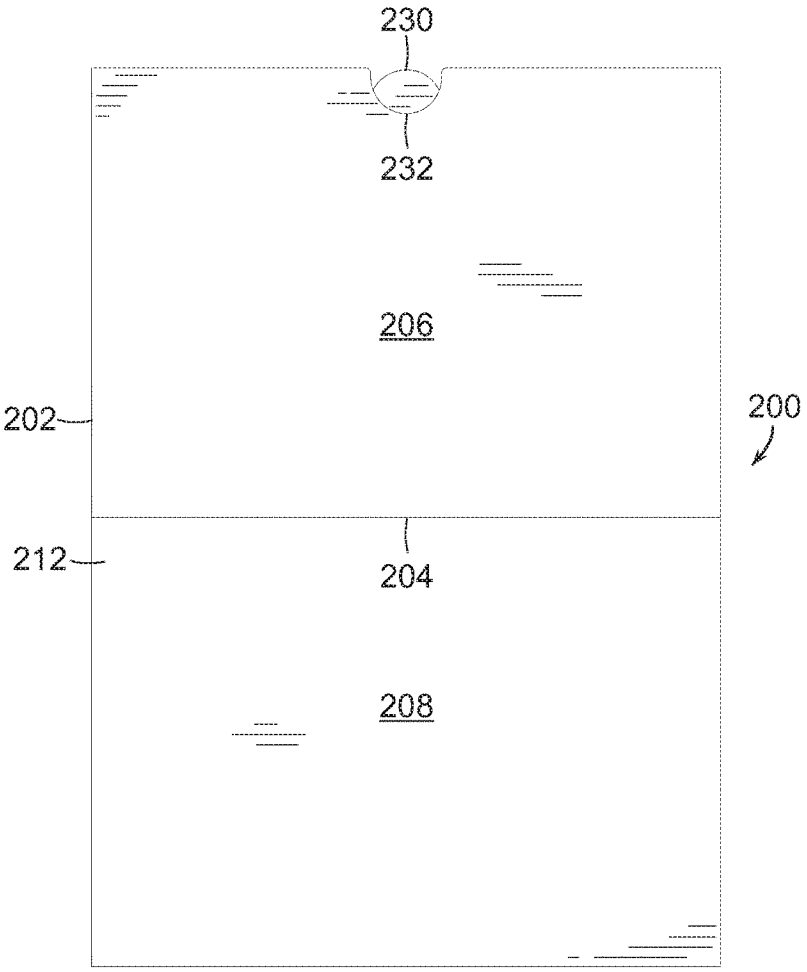
FIG. 7 is a bottom view of the pop-up card in accordance with one or more embodiments.
Figure 6:
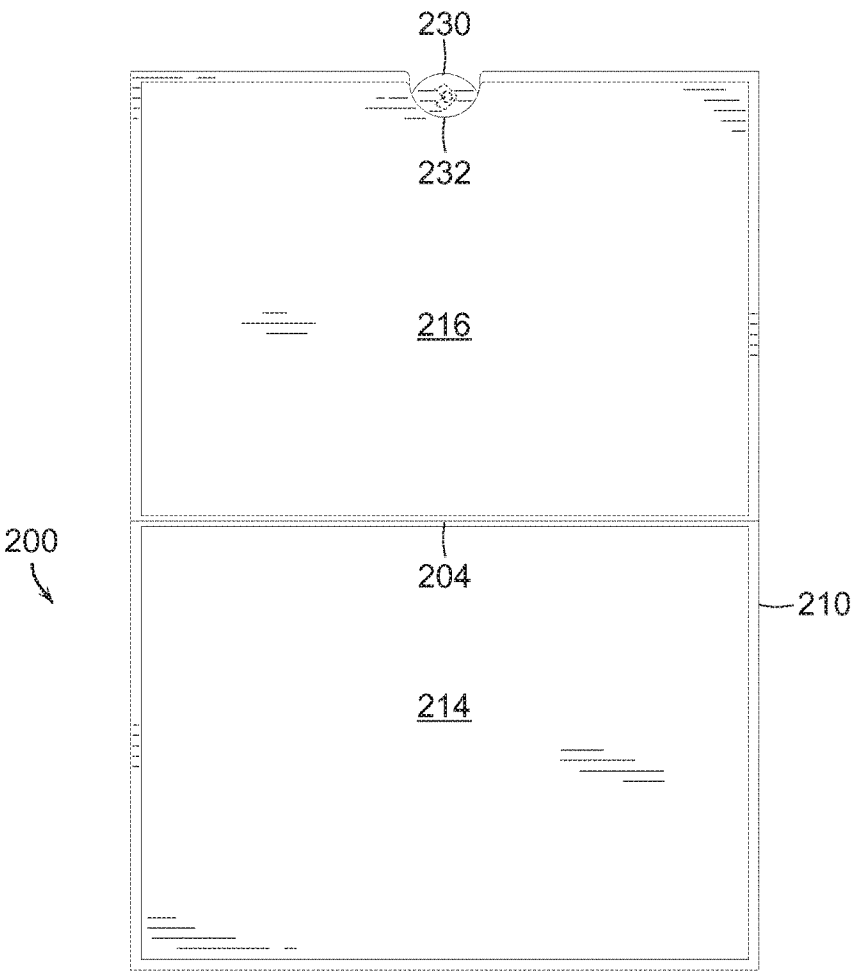
FIG. 6 is a top view of the pop-up card in accordance with one or more embodiments.

FIGS. 4-8 illustrate one example of a pop-up card 200 with an integrated pocket for holding a removable notecard in accordance with one or more embodiments. FIG. 9 shows an exemplary alternative construction of the pop-up card. In each of these figures, the pop-up display structure has been omitted so that the integrated pocket feature can be more easily illustrated. It should be understood that a pop-up structure is intended to be part of the illustrated cards, e.g., in a similar way the pop-up structure in FIGS. 1-3 is included in the card. The pop-up structure can also be removably provided in the card. The pop-up display structure comprises a plurality of intersecting slice-form elements. When the card is in a closed position, the pop-up display structure is in a flattened state, and when the card is in an opened position, the pop-up display structure is in an erected 3-D state.

The pop-up card 200 includes a cover 202 that is foldable along a crease line 204. The cover 202 has an interior face 210 (outer edges of which are shown in FIG. 3) and an opposite exterior face 212 (shown in FIG. 4). The crease line 204 defines a right cover section 206 (forming a back cover) on one side of the crease line 204 and a left cover section 208 (forming a front cover) on the opposite side of the crease line 204. The cover 202 can be folded and unfolded along the crease line 204 between a closed position and an opened position.

A left panel 214 overlays and is secured to the left cover section 208 on the interior face 210 of the cover. A right panel 216 is secured to and overlays the right cover section 206 on the interior face 210 of the cover. The right panel 216 and the right cover section 206 define a pocket therebetween for receiving a notecard 222. The notecard 222 can be slid into and out of the pocket when desired. The pocket is preferably configured such that the notecard 222 slides easily into and out of the pocket when desired, but is held tightly enough to inhibit it from inadvertently slipping out.

Figure 8:
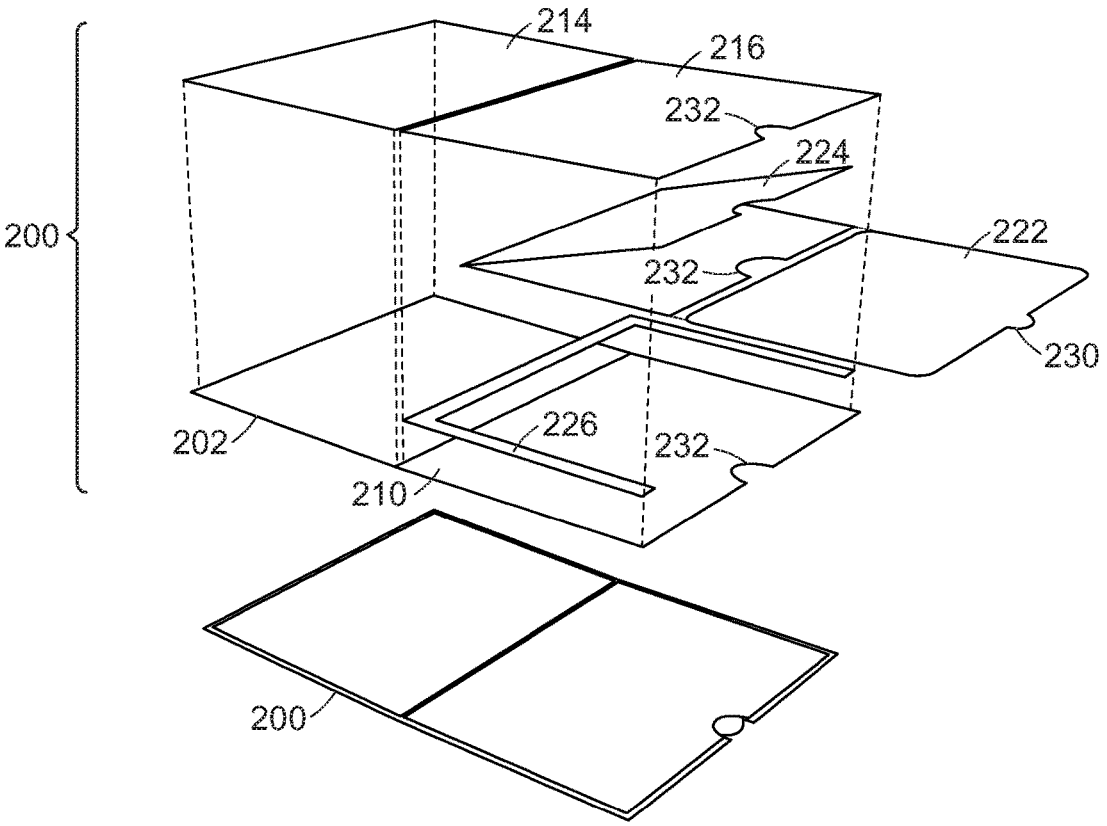
FIG. 8 is an exploded view of the pop-up card in accordance with one or more embodiments.
Figure 9:
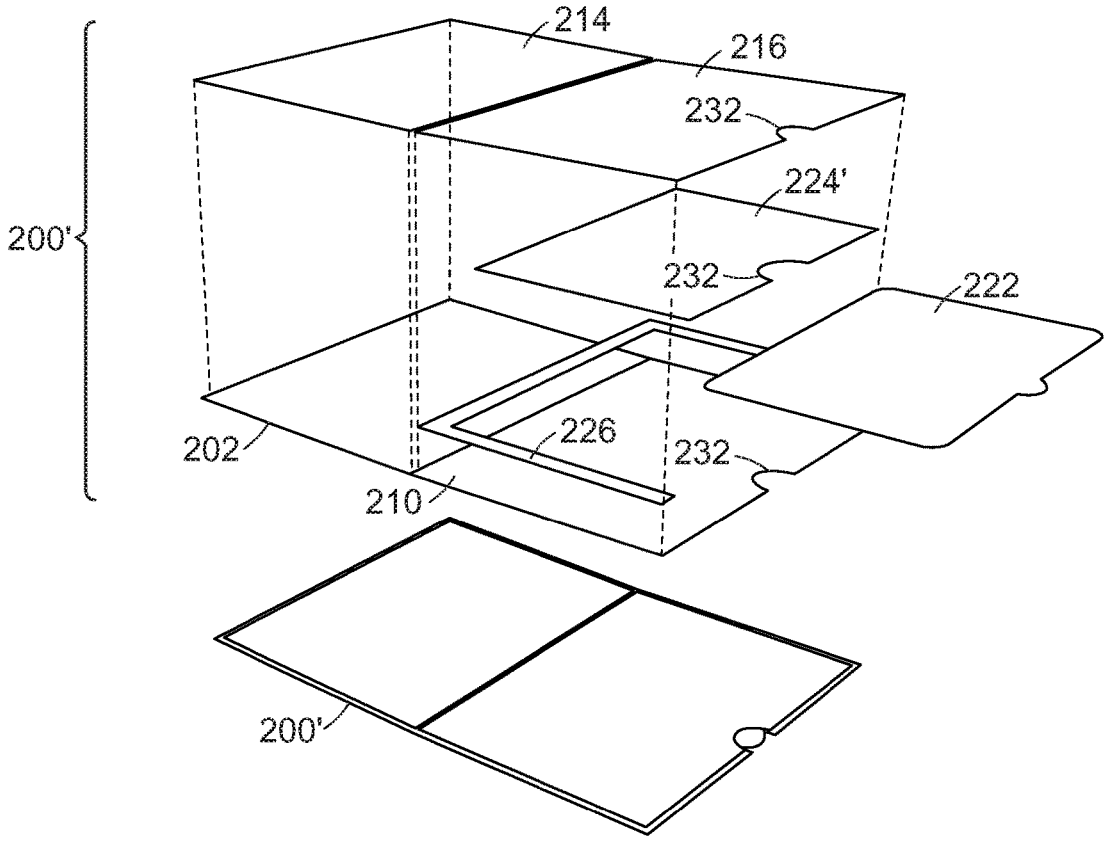
FIG. 9 is an exploded view of an alternate pop-up card in accordance with one or more embodiments.

In one or more further embodiments, a sleeve 224 is provided in the pocket to hold the notecard 222 as illustrated in FIG. 8. The sleeve 224 is positioned within the pocket between the right panel 216 and the cover 202. In the illustrated embodiment, the sleeve 224 comprises a thin envelope style folded piece. The sleeve 224 provides glide surfaces to ease insertion and removal of the notecard 222 from the pocket.

The sleeve 224 protects the notecard 222 from getting caught on the tabs (e.g., 110, 112 in FIG. 2) in the pop-up sculpture that connect the pop-up sculpture to the right panel 216. The sleeve 224 also prevents (or at least inhibits) the notecard 222 from getting caught on any die-cut components of the back cover 202 (e.g., the back cover may include a logo or other information die-cut in the cover). In addition, the fold in the sleeve 224 prevents (or at least inhibits) the notecard sliding too far into the card.

The size and shape of the sleeve 224 can be varied to accommodate different notecard shapes.

The pop-up card 200 also includes a frame structure 226 also secured between the right panel 216 and the cover 202 around three sides of the sleeve 224. The frame structure 226 acts as a spacer to separate the back cover 202 from the right panel 216 in order to provide sufficient space in between layers for the rest of the parts to exist and the notecard 222 to readily slide in and out. It also secures the right panel 216 and the cover 202 to each other.

The sides of the frame structure 226 also function as guiderails for the notecard 222 as it is slid in and out of the sleeve 224. The frame structure 226 also functions as a backstop, preventing over-insertion of the notecard 222 in the pocket.

The size and shape of the frame structure 226 can be varied to accommodate different notecard shapes.

In one or more embodiments, the frame structure 226 can include visual identifiers that allow the assemblers of the pop-up card 200 to place the rest of the parts in their correct places.

In the illustrated embodiments, the notecard 222 has a generally rectangular shape with rounded corners. The notecard 222 may also have square corners. In addition, it may comprise various non-rectangular shapes.

The notecard 222 includes a tab 230 projecting from one side thereof that can be grasped by a user to enable the notecard 222 to be easily removed from the pocket. The back cover 202, the right panel 216, and the sleeve 224 each include a notch 232 therein configured to expose the notecard tab 230 and to enable the user to more easily grasp the tab 230.

The tab 230 and the notches 232 in the card 200 also serve the function of visually indicating the presence of the notecard 222 to a new user who may not have prior knowledge that there is a notecard 222 in the pop-up card 200.

In one or more embodiments, the notecard tab 230 can be marked with visual elements, e.g., product branding marks. In one or more embodiments, physical elements may be provided on the notecard tab 230 in addition to or instead of the visual elements. Non-limiting examples of such physical elements can include embossed elements, Braille text, or a ribbon to assist a user in pulling out the notecard 222.

In the illustrated embodiments, the tab 230 is semicircular in shape. It should be noted that the size, shape, and location of the tab can be varied.

Figure 19:
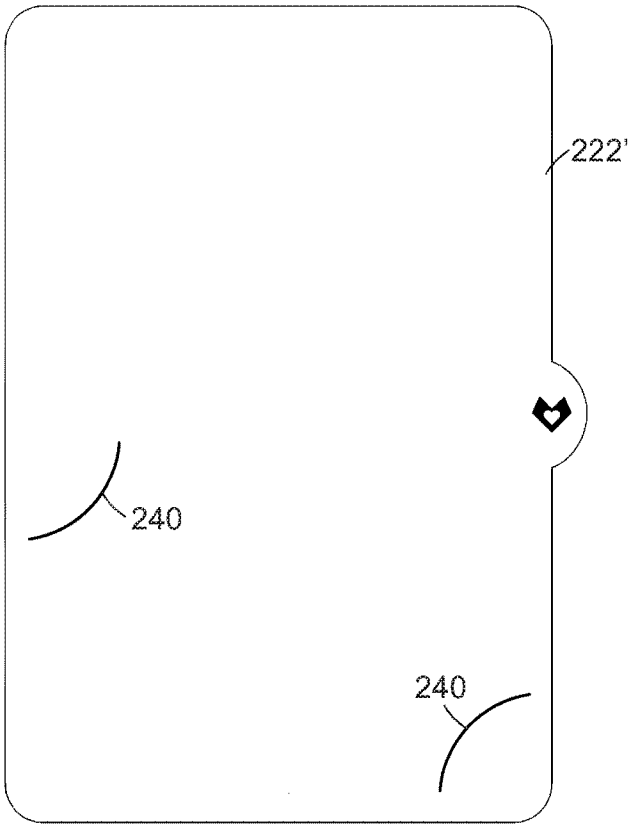

In accordance with one or more embodiments, the notecard 222 can be configured to hold another physical item such as, e.g., a gift card or a piece of jewelry. As shown in FIG. 19, the notecard 222' includes slits 240 on its face for retaining a gift card or other item in place.

FIG. 9 is an exploded view of an alternate pop-up card 200', which is similar to the card 200, but includes a different sleeve 224'. The sleeve 224' comprises a flat non-folded piece secured to the underside of the right panel 216.

In the embodiments illustrated in the figures herein, the pop-up card 200 includes a single notecard on the right side of the card. In other embodiments that are not shown, the notecard may be on the left side of the card. Alternatively, two notecards could be provided: one on the right side of the card and one on the left side of the card.

In one or more alternate embodiments, instead of two panels 214, 216, the pop-up card includes a single panel that covers one or both sides of the cover.

In one or more alternate embodiments, the two panels 214, 216 (or a single panel) overlay and are attached to the exterior side of the cover to define one or more pockets between the exterior side of the cover and the one or more panels for holding the removable notecard.

The following are non-limiting examples illustrating some possible ways in which the notecard of the pop-up card may be used.

Figure 10:
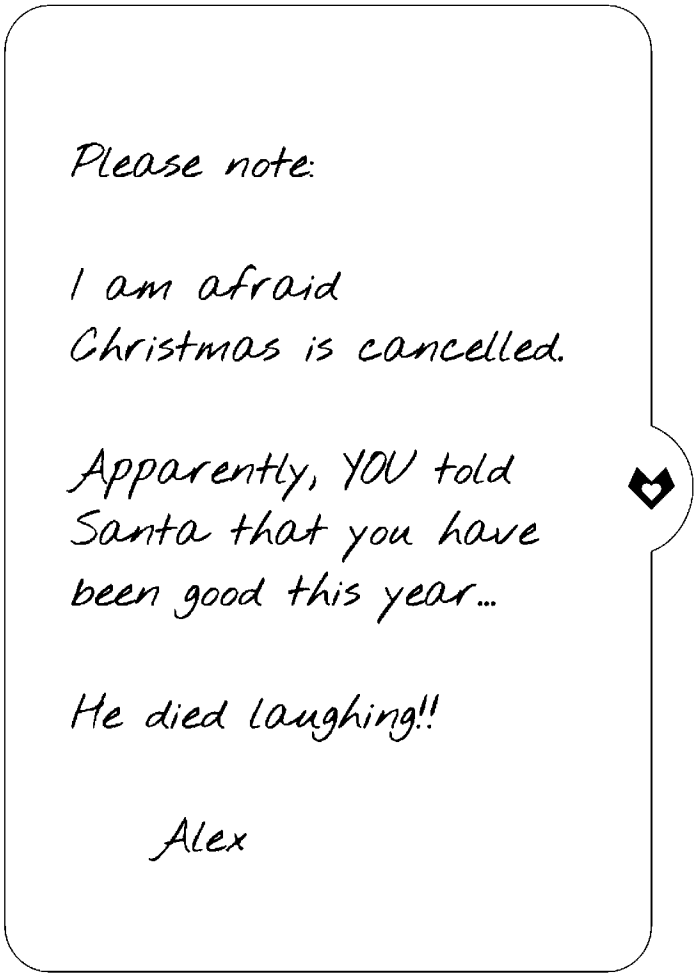
FIGS. 10-19 are top views of exemplary notecards in accordance with one or more embodiments.

As shown in FIG. 10, a user may write or draw on the notecard using a hand writing/drawing instrument like a pen or pencil. A user may print a message on the notecard using a printer.

Figure 11:
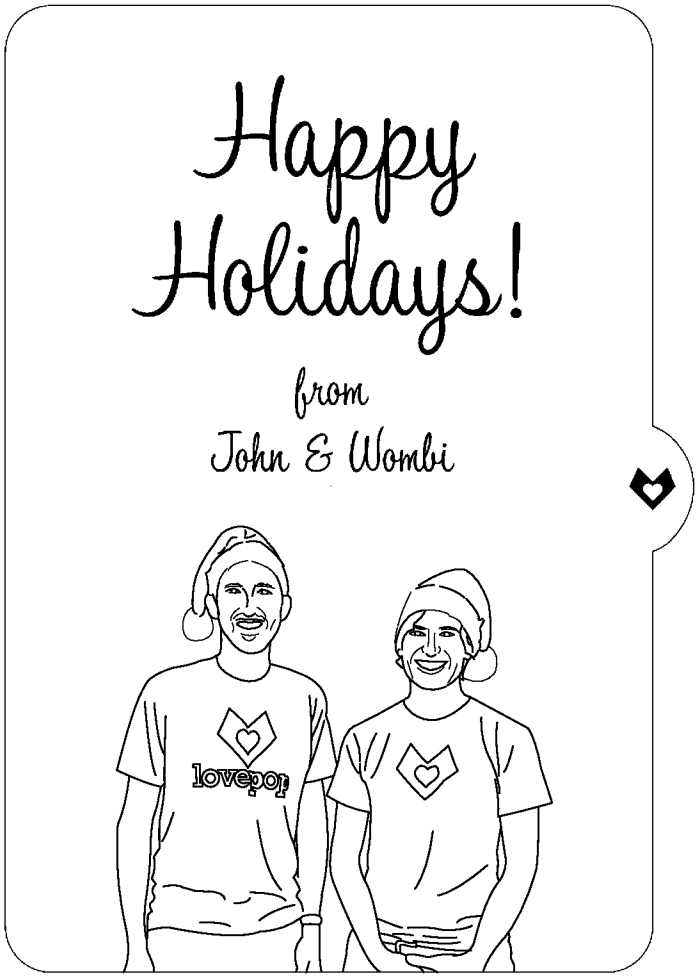

As shown in FIG. 11, a user may print a photograph and message on the notecard using a printer.

Figure 12:
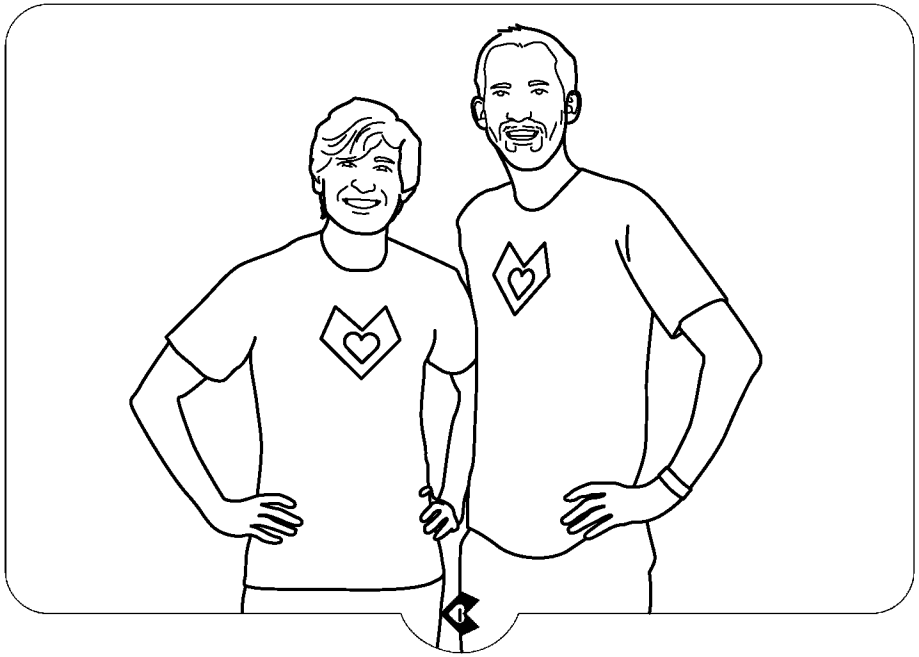

As shown in FIG. 12, a user may print a full bleed photograph on the notecard utilizing the full area of the notecard.

Figure 13:
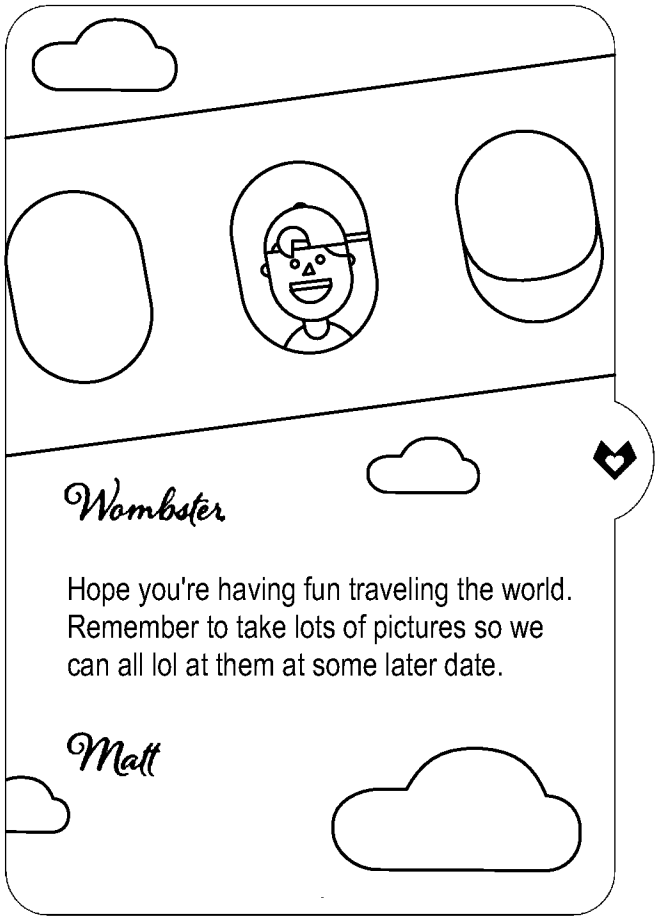

Notecards can include a full color template. The notecard can have a printed pre-determined and user-chosen template as background that covers the whole surface of the notecard. A message can be printed or handwritten on top of the printed template as shown, e.g., in FIG. 13.

Figure 14:
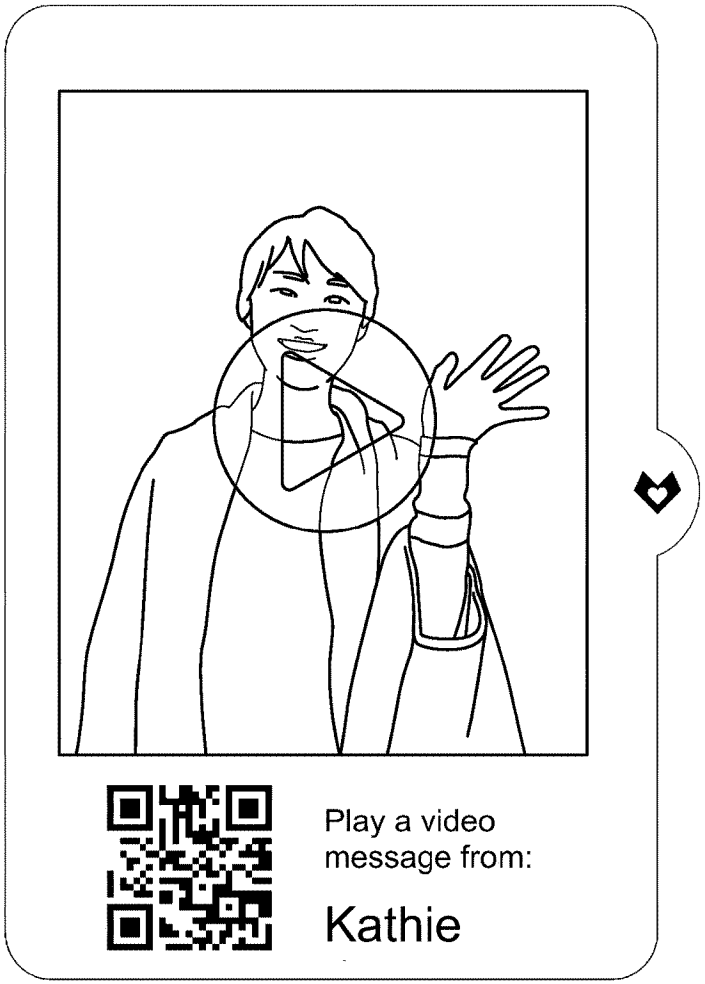

A notecard can include a QR (or other computer-readable) code that the user can read with any QR reading capable device (e.g., a smartphone) for various purposes including, e.g., to access pre-recorded media personalized for the user as shown in FIG. 14 or other information.

Figure 15:
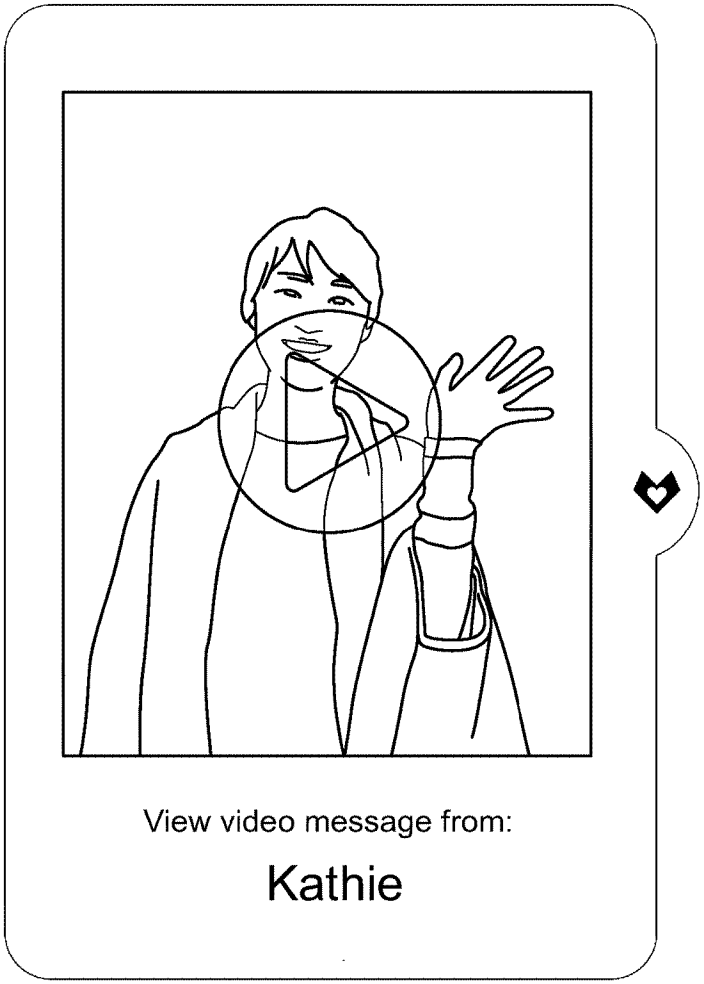

A notecard can have augmented reality (AR) capabilities that allows access to pre-recorded media personalized to the user by detecting the notecard's visual profile and the printed material inside the notecard as shown in FIG. 15.

Figure 18:
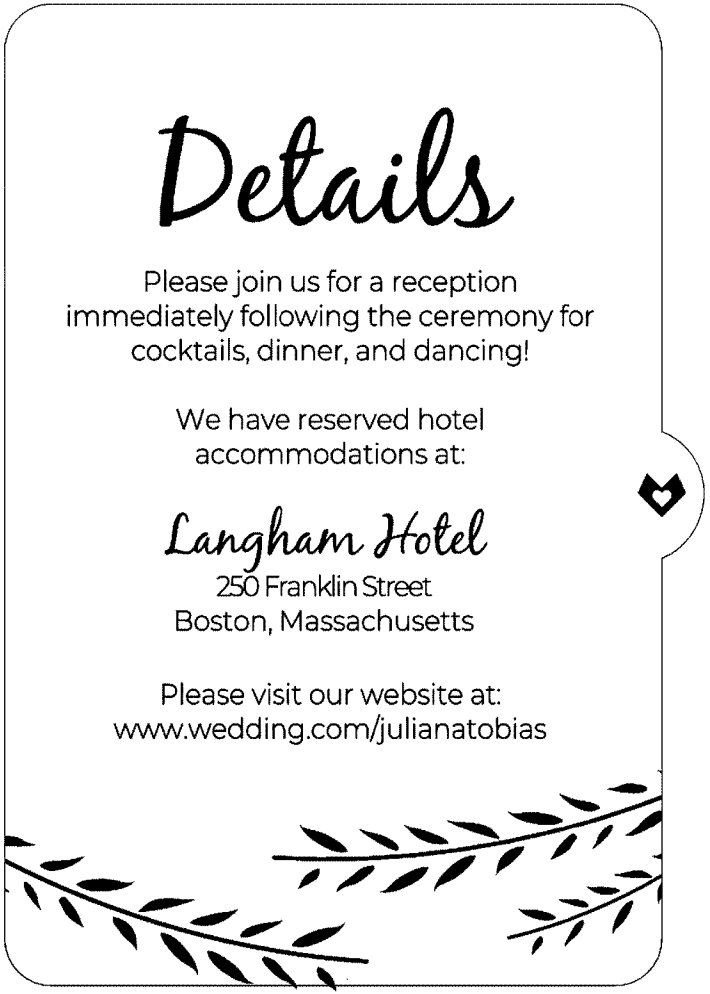

Notecards can be used as a Wedding/Event information card with embellishment and content. A notecard can be the information card for wedding invitations printed in a notecard as shown in FIG. 18. Such notecards can have customizable themes such as different embellishment designs, different positions of embellishments, a full theme template/photograph printed as a background, and customizable text to be written/printed.

Figure 17:
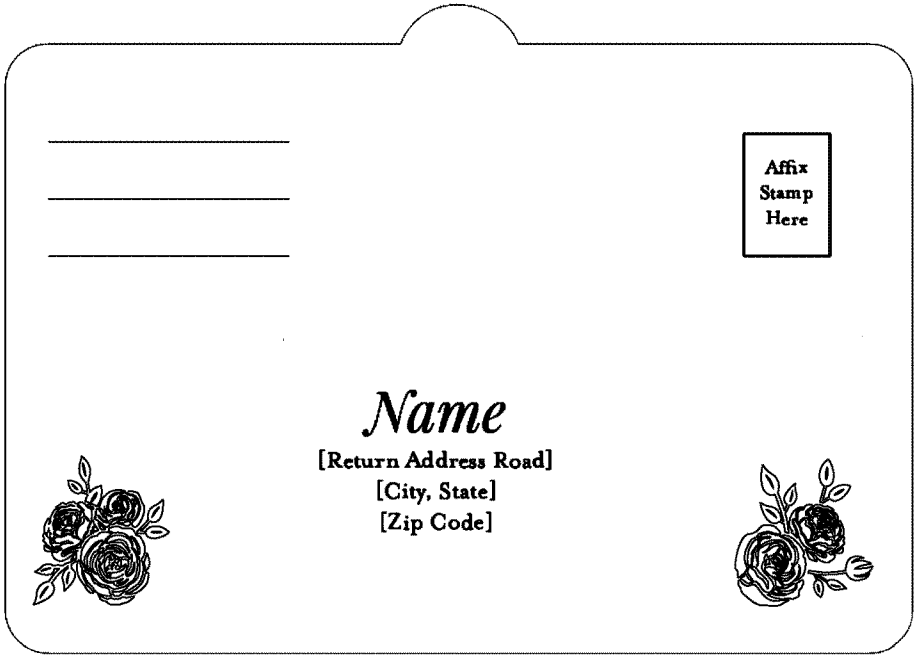
Figure 16:
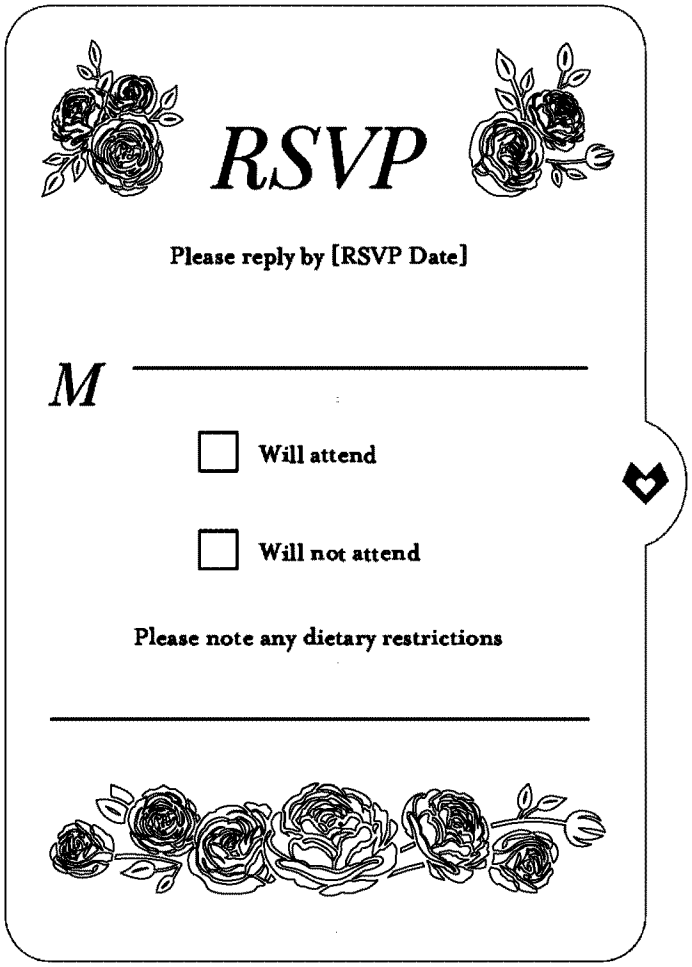

The notecard can be a wedding RSVP card as shown, e.g., in FIG. 16. The notecard can have a customizable return address on the back of the notecard as shown, e.g., in FIG. 17. The notecards can have customizable themes including different embellishment designs, different positions of embellishments, full theme template/photograph printed as a background, customizable text to be written/printed.

Notecards can also be used for branding/merchandising. For example, a physical wallet-sized gift card can be attached to the notecard as shown in FIG. 19. The notecard can include a printable code that can be used as an in-store credit to an online store. The notecard can be a branded, full bleed card in the styling of a gift card from the company issuing the gift card. In addition, the notecard can be a bi-fold notecard that can be used as a pull out brochure.

Figure 20:
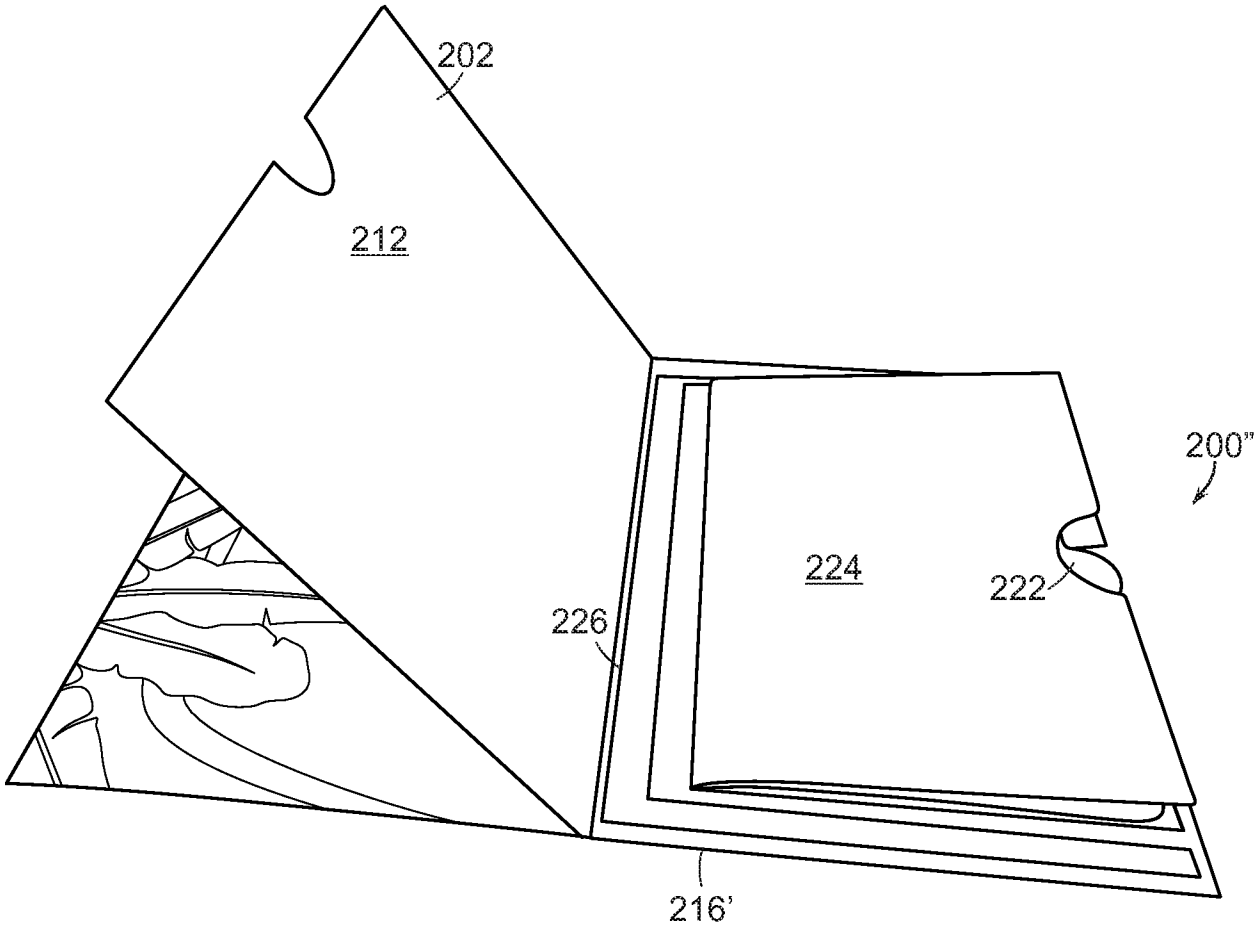
FIG. 20 illustrates a pop-up card having a panel overlaying an exterior surface of the card cover in accordance with one or more embodiments.

In embodiments such as the FIG. 8 pop-up card 200, a right panel 216 is secured to and overlays the right cover section 206 on the interior face 210 of the cover 202 to define a pocket there-between for receiving a notecard 222. FIG. 20 illustrates an alternative embodiment 200" in which the pocket for holding the notecard 222 is formed by the card cover 202 and a panel 216' overlaying the exterior face 212 of the card cover 202. In FIG. 20, the panel 216' is shown unattached to the card cover 202 for purposes of illustration. The panel 216' is glued or otherwise attached to the card cover 202.

A sleeve 224 (like the sleeve 224 of FIG. 8) is provided in the pocket to receive the notecard 222. A frame structure 226 (like the frame structure 226 of FIG. 8) is secured between the panel 216' and the cover 202 around three sides of the sleeve 224.

Having thus described several illustrative embodiments, it is to be appreciated that various alterations, modifications, and improvements will readily occur to those skilled in the art. Such alterations, modifications, and improvements are intended to form a part of this disclosure, and are intended to be within the spirit and scope of this disclosure. While some examples presented herein involve specific combinations of functions or structural elements, it should be understood that those functions and elements may be combined in other ways according to the present disclosure to accomplish the same or different objectives. In particular, acts, elements, and features discussed in connection with one embodiment are not intended to be excluded from similar or other roles in other embodiments.

Additionally, elements and components described herein may be further divided into additional components or joined together to form fewer components for performing the same functions.

Accordingly, the foregoing description and attached drawings are by way of example only, and are not intended to be limiting.

The invention claimed is:

1. A pop-up card with a removable notecard, comprising:

a pop-up card comprising (a) a cover having an interior face and an opposite exterior face, said cover being foldable along a crease line defining a first section of the cover on one side of the crease line and a second section of the cover on the opposite side of the crease line, said cover being foldable and unfoldable along the crease line between a closed position wherein the first section of the interior face of the cover faces the second section of the interior face of the cover and an opened position wherein the first section of the interior face of the cover and the second section of the interior face of the cover are separated;

(b) a panel secured to and overlaying at least a portion of the second section of the cover, wherein the panel and the second section of the cover define a pocket therebetween, wherein the panel includes one or more slots therein; and (c) an erectable pop-up display structure comprising a plurality of intersecting slice-form elements on the interior face of the cover such that when the cover is in the closed position, the pop-up display structure is in a flattened state, and wherein when the cover is in the opened position, the pop-up display structure is in an erected 3-D state, wherein the pop-up display structure includes one or more tabs at the base thereof, said one or more tabs being inserted into and retained in said one or more slots of the panel in the pocket between the panel and the second section of the cover; and a notecard removably and slidably inserted in the pocket between the panel and the second section of the cover;

wherein the pop-up card further comprises means for separating the one or more tabs of the pop-up display structure from the notecard when the notecard is inserted in the pocket to inhibit or prevent the notecard from engaging the one or more tabs.

2. The pop-up card of claim 1, wherein the means for separating the one or more tabs of the pop-up display structure from the notecard comprises a sleeve fixedly positioned within the pocket, said sleeve providing one or more glide surfaces for the notecard to ease insertion and removal of the notecard from the pocket.

3. The pop-up card of claim 2, further comprising a frame structure secured between the panel and the second section of the cover around at least portions of the three sides of the sleeve forming guiderails and a backstop for the notecard in the pocket, wherein one side of the frame structure is fixedly secured to a surface of the panel facing the second section of the cover, and an opposite side of the frame structure is fixedly secured to a surface of the second section of the cover facing the panel.

4. The pop-up card of claim 1, further comprising a frame structure secured between the panel and the second section of the cover around at least portions of the three sides of the notecard, said frame structure forming guiderails and a backstop for the notecard in the pocket, wherein one side of the frame structure is fixedly secured to a surface of the panel facing the second section of the cover, and an opposite side of the frame structure is fixedly secured to a surface of the second section of the cover facing the panel.

5. The pop-up card of claim 1, wherein the notecard includes a tab at one end thereof projecting from the pocket to improve detection of the notecard and to facilitate removal of the notecard from the pocket.

6. The pop-up card of claim 5, wherein the tab is semi-circular in shape.

7. The pop-up card of claim 5, wherein the tab includes physical and/or printed markings thereon.

8. The pop-up card of claim 1, wherein the panel and the second section of the cover each include a notch exposing a portion of the notecard in the pocket to improve detection of the notecard and to facilitate removal of the notecard from the pocket.

9. The pop-up card of claim 1, wherein the notecard includes a tab at one end thereof projecting from the pocket, and wherein the panel and the second section of the cover each include a notch about the tab on the notecard to improve detection of the notecard and to facilitate removal of the notecard from the pocket.

10. The pop-up card of claim 1, wherein the panel is on the right side of the pop-up card.

11. The pop-up card of claim 1, wherein the panel is on the left side of the pop-up card.

12. The pop-up card of claim 1, wherein the cover and the panel comprise card stock.

13. The pop-up card of claim 1, wherein the notecard has rounded corners or square corners.

14. The pop-up card of claim 1, wherein the notecard includes one or more slits for receiving and holding an item.

15. The pop-up card of claim 14, wherein the item comprises a gift card or a gift item.

16. The pop-up card of claim 1, wherein the panel is secured to and overlays the second section of the interior face of the cover.

17. The pop-up card of claim 1, wherein the panel is secured to and overlays the second section of the exterior face of the cover.

18. The pop-up card of claim 1, wherein the panel is secured to and overlays at least a portion of the first section and at least a portion of the second section of the cover.

19. The pop-up card of claim 1, further comprising an additional panel secured to and overlaying at least a portion of the first section of the cover.

20. The pop-up card of claim 19, wherein the panel is secured to and overlays the second section of the interior face of the cover, and the additional panel is secured to and overlays the first section of the interior face of the cover.

21. The pop-up card of claim 1, wherein the means for separating the one or more tabs of the pop-up display structure from the notecard comprises a flat piece fixedly secured to an underside of the panel within the pocket.

22. A pop-up card with a removable notecard, comprising:

a notecard including a tab at one end thereof; and a pop-up card comprising (a) a cover having an interior face and an opposite exterior face, said cover being foldable along a crease line defining a first section of the cover on one side of the crease line and a second section of the cover on the opposite side of the crease line, said cover being foldable and unfoldable along the crease line between a closed position wherein the first section of the interior face of the cover faces the second section of the interior face of the cover and an opened position wherein the first section of the interior face of the cover and the second section of the interior face of the cover are separated;

(b) a first panel secured to and overlaying at least a portion of the first section of the interior face of the cover;

(c) a second panel secured to and overlaying at least a portion of the second section of the interior face of the cover, wherein the second panel and the second section of the cover define a pocket therebetween for receiving and holding the notecard, wherein the tab is visible when the notecard is in the pocket to improve detection of the notecard and to facilitate removal of the notecard from the pocket, wherein the second panel includes one or more slots therein;

(d) an erectable pop-up display structure comprising a plurality of intersecting slice-form elements on the first and second panels such that when the cover is in the closed position, the pop-up display structure is in a flattened state, and wherein when the cover is in the opened position, the pop-up display structure is in an erected 3-D state, wherein the pop-up display structure includes one or more tabs at the base thereof, said one or more tabs being inserted into and retained in said one or more slots of the second panel in the pocket between the second panel and the second section of the cover; and (e) means for separating the one or more tabs of the pop-up display structure from the notecard when the notecard is inserted in the pocket to inhibit or prevent the notecard from engaging the one or more tabs.

23. The pop-up card of claim 22, wherein the means for separating the one or more tabs of the pop-up display structure from the notecard comprises a sleeve fixedly positioned within the pocket, said sleeve providing one or more glide surfaces for the notecard to ease insertion and removal of the notecard from the pocket.

24. The pop-up card of claim 23, further comprising a frame structure secured between the second panel and the second section of the cover around at least portions of the three sides of the sleeve forming guiderails and a backstop for the notecard in the pocket, wherein one side of the frame structure is fixedly secured to a surface of the panel facing the second section of the cover, and an opposite side of the frame structure is fixedly secured to a surface of the second section of the cover facing the panel.

25. The pop-up card of claim 22, wherein the second panel and the second section of the cover each include a notch exposing a portion of the notecard in the pocket to improve detection of the notecard and to facilitate removal of the notecard from the pocket.

26. The pop-up card of claim 22, wherein the notecard includes one or more slits for receiving and holding an item.

27. The pop-up card of claim 22, wherein the means for separating the one or more tabs of the pop-up display structure from the notecard comprises a flat piece fixedly secured to an underside of the second panel within the pocket.

* * * * *